US010186796B2

(12) United States Patent
Kato

(10) Patent No.: US 10,186,796 B2
(45) Date of Patent: Jan. 22, 2019

(54) CONNECTOR UNIT, SUB-CONNECTOR WITH FRAME AND SUB-CONNECTOR WITH CAP

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Shigeto Kato, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/328,585

(22) PCT Filed: Jul. 9, 2015

(86) PCT No.: PCT/JP2015/069714
§ 371 (c)(1),
(2) Date: Jan. 24, 2017

(87) PCT Pub. No.: WO2016/017392
PCT Pub. Date: Feb. 4, 2016

(65) Prior Publication Data

US 2017/0222352 A1 Aug. 3, 2017

(30) Foreign Application Priority Data

Jul. 30, 2014 (JP) ..... 2014-154534

(51) Int. Cl.
*H01R 13/04* (2006.01)
*H01R 13/502* (2006.01)
(Continued)

(52) U.S. Cl.
CPC ..... *H01R 13/502* (2013.01); *H01R 13/04* (2013.01); *H01R 13/514* (2013.01); *H01R 13/518* (2013.01); *H01R 13/506* (2013.01)

(58) Field of Classification Search
CPC .... H01R 13/04; H01R 13/502; H01R 13/514; H01R 13/518; H01R 13/04367; H01R 13/50; H01R 13/506
See application file for complete search history.

(56) References Cited

U.S. PATENT DOCUMENTS 4,976,628 A * 12/1990 Fedder ..... H01R 9/032 439/101
5,170,326 A * 12/1992 Meny ..... H05K 1/028 174/254
(Continued)

FOREIGN PATENT DOCUMENTS

JP 64-56160 4/1989
JP 8-106949 4/1996
(Continued)

OTHER PUBLICATIONS

International Search Report dated Oct. 6, 2015.

*Primary Examiner* — James Harvey
*Assistant Examiner* — Oscar Jimenez
(74) *Attorney, Agent, or Firm* — Gerald E. Hespos; Michael J. Porco; Matthew T. Hespos

(57) ABSTRACT

A connector unit (30) is configured to be connectable to a mating connector (10). The connector unit (30) includes a plurality of sub-connectors (40, 50, 60) and a frame (32). Each of the sub-connectors (40, 50, 60) includes a connector housing (42, 52, 62) and male terminals (46, 56, 66) held by the connector housing with male terminal portions (47, 57, 67) projecting out from the connector housing. The frame (32) includes a uniting frame portion (34) for holding the plurality of sub-connectors in a united state with the male
(Continued)

terminal portions of the plurality of sub-connectors facing in the same direction and a surrounding frame portion (36) for surrounding the male terminal portions of the plurality of sub-connectors.

3 Claims, 4 Drawing Sheets

(51) Int. Cl.
*H01R 13/506* (2006.01)
*H01R 13/514* (2006.01)
*H01R 13/518* (2006.01)

(56) References Cited

U.S. PATENT DOCUMENTS 5,443,403 A * 8/1995 Weidler ..... H01R 13/518 439/557
5,855,486 A 1/1999 Fukamachi et al.
5,913,703 A * 6/1999 Suzuki ..... H01R 13/518 439/489
6,022,247 A * 2/2000 Akiyama ..... B60R 16/0238 439/701
6,969,279 B1 * 11/2005 Mahoney ..... H01R 13/5208 439/589
7,641,514 B2 * 1/2010 Chen ..... H01R 13/518 439/540.1
8,408,945 B2 * 4/2013 Schober ..... H05K 5/0039 439/660
2010/0136847 A1 * 6/2010 Hung ..... H01R 13/514 439/701
2011/0007464 A1 * 1/2011 Leigh ..... H01R 9/2408 361/679.01
2011/0111631 A1 * 5/2011 Shi ..... H01R 13/5812 439/625
2012/0190235 A1 * 7/2012 Sakurai ..... H01R 43/24 439/540.1
2013/0109203 A1 * 5/2013 Nakanishi ..... B29C 45/1671 439/65
2013/0252464 A1 * 9/2013 McAlonis ..... H01R 13/518 439/607.01
2014/0024262 A1 1/2014 Okamoto et al.
2015/0126082 A1 * 5/2015 Furukawa ..... H01R 13/518 439/892
2016/0049758 A1 * 2/2016 Ohnuki ..... H01R 13/6593 439/638
2016/0322770 A1 * 11/2016 Zerebilov ..... H01R 11/09

FOREIGN PATENT DOCUMENTS

JP 2008-71704 3/2008
JP 2012-142221 7/2012
JP 2012-226882 11/2012

* cited by examiner

CONNECTOR UNIT, SUB-CONNECTOR WITH FRAME AND SUB-CONNECTOR WITH CAP

BACKGROUND

1. Field of the Invention

This invention relates to a technique for collectively connecting a plurality of sub-connectors to another connector.

2. Description of the Related Art

Japanese Unexamined Patent Publication No. H08-106949 discloses a split connector that includes a male frame and a female frame paired with each other and in which male sub-connectors having male terminal fittings mounted therein and female sub-connectors having female terminal fittings mounted therein are accommodated in a plurality of accommodation holes formed in the corresponding frames. The corresponding male and female sub-connectors are fit and connected by displacing the frames in directions toward each other by a connecting member provided between the frames.

The above-described male sub-connector has a substantially rectangular parallelepiped outer shape and a fitting recess is formed on the upper surface of the male sub-connector for receiving a fitting protrusion of the mating female sub-connector. Unillustrated cavities are formed in alignment in each male sub-connector, and the male terminal fitting is mounted in each cavity with a tab thereof projecting into the fitting recess.

In Japanese Unexamined Patent Publication No. H08-106949, the fitting recess is formed in each of the male sub-connectors. The fitting recess functions to protect the tabs of the male terminal fittings and guide the fitting protrusion of the female sub-connector.

Further, the assembly of the female sub-connectors, each including the fitting protrusion fittable into the fitting recess, is used as a mating connector. Thus, the mating connector is largely restricted.

Accordingly, an object of the present invention is to enable restrictions on a mating connector to be reduced in the case of configuring a connector unit by combining a plurality of sub-connectors including male terminals.

SUMMARY

To solve the above problem, a first aspect of the present invention is directed to a connector unit to be connected to a mating connector. The connector unit has a plurality of sub-connectors, with each sub-connector including a connector housing and at least one male terminal held by the connector housing so that a male terminal portion projects out from the connector housing. The connector unit further has a frame including a uniting frame portion for holding the plurality of sub-connectors in a united state with the male terminal portions of the sub-connectors facing in the same direction and a surrounding frame portion for surrounding the male terminal portions of the sub-connectors.

The frame of the connector unit may be formed integrally to any one of the plurality of sub-connectors. With this arrangement, at least one other sub-connector can be incorporated into the frame that is formed integrally to the sub-connector.

The sub-connector integrally formed to the frame may be mountable on a mounting board. With this arrangement, the sub-connector mountable on the mounting board and the other sub-connector can be combined.

The invention also is directed to a sub-connector with a frame including a connector housing. At least one male terminal is held by the connector housing so that a male terminal portion projects out from the connector housing. A frame is formed integrally to the connector housing and includes a uniting frame portion for holding the connector housing and another connector housing in a united state. A surrounding frame portion surrounds the male terminal portion projecting from the connector housing and a male terminal portion projecting from the other connector housing. With this arrangement, the other sub-connector can be incorporated into the frame that is formed integrally to the sub-connector.

The invention further relates to a sub-connector with cap including a connector housing, at least one male terminal held by the connector housing with a male terminal portion projecting out from the connector housing, and a cap for covering the male terminal portion projecting from the connector housing. The cap is formed with a hole enabling an external terminal to come into contact with the male terminal portion. With this arrangement, the male terminal portions can be protected before the sub-connector is incorporated into the frame. Further, a continuity check or the like through the male terminal can be carried out through the hole formed in the cap.

Effects

According to the above-described embodiments, the connector unit can be configured by combining the plurality of sub-connectors including the male terminals by the uniting frame portion of the frame. At this time, the surrounding frame portion of the frame surrounds the male terminal portions of the plurality of sub-connectors. This surrounding frame portion can function to protect the male terminal portions and guide the mating connector. Thus, the mating connector need not have a split structure or the like corresponding to the plurality of sub-connectors and restrictions on the mating connector can be reduced.

DETAILED DESCRIPTION

Figure 1:
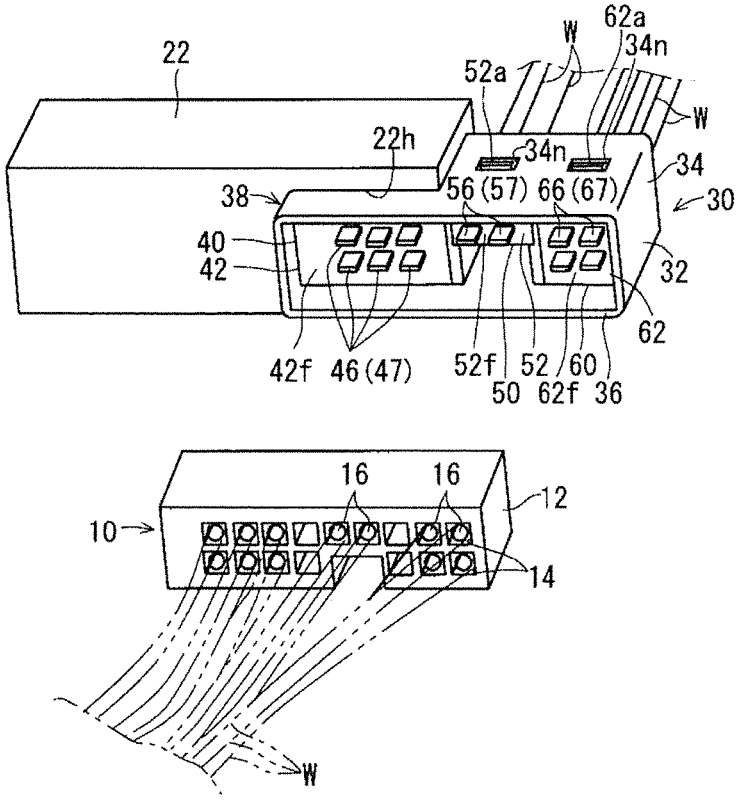
FIG. 1 is a schematic perspective view showing a connector unit according to an embodiment.
Figure 2:
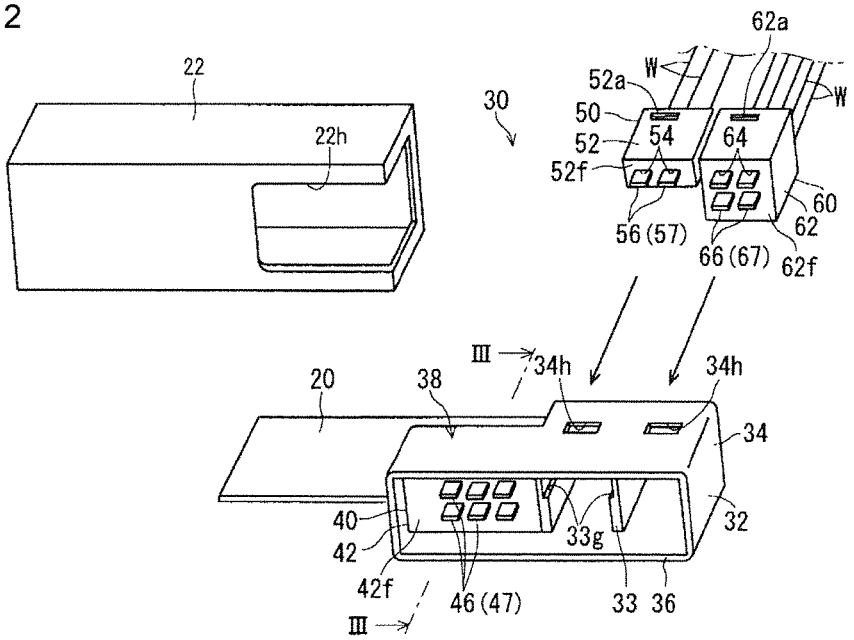
FIG. 2 is a schematic exploded perspective view of the connector unit.
Figure 3:
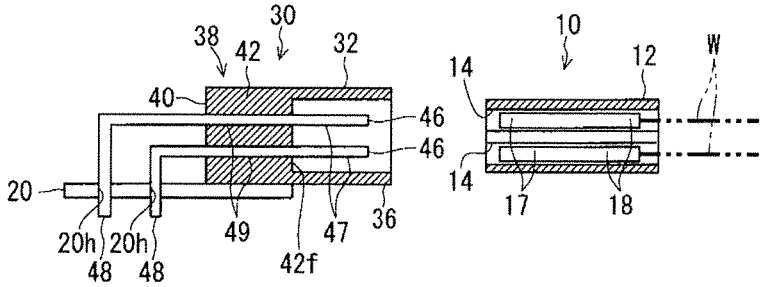
FIG. 3 is a schematic section along of FIG. 2.

Hereinafter, a connector unit and a sub-connector with frame according to an embodiment are described. FIG. 1 is a schematic perspective view showing a connector unit 30, FIG. 2 is a schematic exploded perspective view of the connector unit 30, and FIG. 3 is a schematic section along of FIG. 2.

The connector unit 30 is to be connected to a mating connector 10 and includes a plurality of (here, three) sub-connectors 40, 50 and 60 and a frame 32.

The mating connector 10 includes a connector housing 12 and a plurality of female terminals 16.

The connector housing 12 is formed of resin or the like into a rectangular parallelepiped shape (here, a rectangular parallelepiped shape elongated in a lateral direction). Cavities 14 penetrate the connector housing 12 in a front-back direction thereof. Here, the connector housing 12 is formed with the cavities 14 in upper and lower stages arranged so that nine cavities 14 are formed in the upper stage and seven cavities 14 are formed in the lower stage. In the lower stage of the connector housing 12, seven cavities 14 are divided into three cavities 14 and four cavities 14 and an interval corresponding to two cavities 14 is provided between the three cavities 14 and the four cavities 14. A recess is formed in a part between the three cavities 14 and the four cavities 14 in a lower part of the connector housing 12.

The female terminal 16 is formed by appropriately press-forming a metal plate or the like and includes a wire connecting portion 18 and a female terminal portion 17, which are connected in a straight line.

An end part of a wire W is connected to the wire connecting portion 18, such as by crimping. Normally, the wire connecting portion 18 includes a crimping piece crimpable to a core of the end part of the wire W and the end part of the wire W and the wire connecting portion 18 are connected by caulking the crimping piece to the core.

The female terminal portion 17 is formed into a tubular shape (rectangular tube shape or cylindrical tube shape) and a male terminal portion 47, 57, 67 (to be described later) is inserted into the female terminal portion 17 for connection through a tip side opening of the female terminal portion 17.

The female terminal portions 17 are accommodated and held in all or some of the cavities 14 of the connector housing 12 (here, cavities 14 excluding third ones from right and fourth ones from left in FIG. 1). Vertical rows where the female terminal portions 17 are not accommodated and held correspond to intervals between the sub-connectors 40 and 50 and between the sub-connectors 50 and 60. Normally, the female terminal 16 is positioned and supported at a fixed position in the cavity 14, such as by locking the female terminal 16 by a locking piece (part also called a locking lance) that projects into the cavity 14, or by pressing a member, called a retainer, mounted in the connector housing 12 against the female terminal 16.

The female terminals 16 connected to the end parts of the respective wires W are accommodated and held in the cavities 14 of the connector housing 12. Specifically, the mating connector 10 is provided on the end parts of the plurality of wires W.

One sub-connector 40, out of the plurality of sub-connectors 40, 50 and 60, is formed integrally with a frame 32, and the other sub-connectors 50, 60 are separate from the frame 32. That is, the sub-connector 40 and the frame 32 are configured as a sub-connector with frame 38. Here, an example is described in which the sub-connector with frame 38 is of a type to be mounted and fixed to a mounting board 20.

The sub-connector with frame 38 includes the sub-connector 40 and the frame 32. The sub-connector 40 includes a connector housing 42 and male terminals 46. This sub-connector 40 is configured to be mountable on the mounting board 20.

The connector housing 42 is formed of resin or the like into a rectangular parallelepiped shape, and one principal surface thereof serves as a facing surface 42*f* that faces the connector housing 12.

The male terminal 46 is formed by appropriately press-forming a metal plate or the like and includes a male terminal portion 47, a board connecting portion 48 and an intermediate portion 49. The male terminal portion 47 is an elongated part formed into a long and thin plate or a pin (here, long and thin plate). The male terminal portion 47 is insertable into and connectable to the female terminal portion 17. The intermediate portion 49 is a long and thin part connected in a straight line to a base end part of the male terminal portion 47. Further, the board connecting portion 48 is formed into a long and thin shape extending from an end part of the intermediate portion 49 opposite to the male terminal portion 47 out of opposite end parts of the intermediate portion 49 while being perpendicular to the intermediate portion 49. Thus, the whole male terminal 46 is L-shaped in side view. The male terminal may also be straight.

The male terminal 46 is held in the connector housing 42 such that the male terminal portion 47 projects from the facing surface 42*f* of the connector housing 42 and the board connecting portion 48 projects from the back surface of the connector housing 42. Here, the connector housing 42 is formed by insert molding with parts of the intermediate portions 49 as insert parts.

Here, the male terminal portions 47 of a plurality of (here, six) male terminals 46 project from the facing surface 42*f* of the connector housing 42 with a plurality of (here, three) male terminal portions 47 aligned in each of upper and lower stages. The connector housing 42 itself (excluding a part by the frame 32 to be described later) is not formed with a part surrounding the facing surface 42*f* Thus, the male terminal portions 47 can be seen to be projecting from the connector housing 42 when the connector housing 42 itself is seen as a whole.

The board connecting portion 48 projects toward the bottom surface side of the connector housing 42 behind the connector housing 42. Note that the intermediate portions 49 and the board connecting portions 48 differ in length between the male terminals 46 incorporated in the upper stage of the connector housing 42 and the male terminals 46 incorporated in the lower stage so that the board connecting portions 18 do not contact each other. More particularly, the intermediate portions 49 and the board connecting portions 48 of the male terminals 46 in the upper stage circumvent the intermediate portions 49 and the board connecting portions 48 of the male terminals 46 in the lower stage.

With the sub-connector 40 disposed on the mounting board 20, tip parts of the board connecting portions 48 are inserted and connected to through holes 20*h* formed in the mounting board 20. In this way, the board connecting portions 48 of the male terminals 46 are connected electrically to a wiring pattern formed on the mounting board 20. The board connecting portions 48 and the wiring pattern may be connected electrically by soldering or by press-fitting the tip parts of the board connecting portions 48 into the through holes to be pressed against wirings formed on the inner surfaces of the through holes (also called press-fit terminals or the like).

The terminals integrated with the connector housing 42 as insert parts as described above preferably have as simple a shape as possible for the sake of processing. Also in this embodiment the male terminals 46 having a relatively simple shape are incorporated into the connector housing 42 rather than female terminals that have a relatively complicated shape.

Note that various electrical components such as semiconductor components are mounted on the mounting board 20 and the wiring pattern is connected to the electrical components mounted on the mounting board 20. Thus, the male terminals 46 are used as terminals for connecting an electrical circuit formed on the mounting board 20 to an external electrical device.

The connector housing 42 preferably is fixed to the mounting board 20 with the board connecting portions 48 of the male terminals 46 connected to the mounting board 20. The connector housing 42 and the mounting board 20 can be fixed, such as by screwing or by press-fitting a protrusion projecting on the connector housing 42 into the mounting board 20.

Further, the mounting board 20 is accommodated into a device casing 22. The device casing 22 is formed of resin, metal or the like into a box shape. The device casing may be configured by a combination of a casing body portion open on one side and a lid portion.

This device casing 22 is formed with an opening 22*h* for allowing the sub-connector 40 to project outward. The sub-connector 40 projects out from the device casing 22 through the opening 22*h* with the mounting board 20 fixed to the device casing 22 by screwing or the like.

Each of the sub-connectors 50, 60 includes a connector housing 52, 62 and male terminals 56, 66.

Each connector housing 52, 62 is formed of resin or the like into a rectangular parallelepiped shape. Each connector housing 52, 62 is formed with a plurality of cavities 54, 64 penetrating in a front-back direction thereof. Here, the connector housing 52 is formed with two cavities 54 in one stage. The connector housing 62 is formed with two cavities 64 in each of upper and lower stages.

Figure 5:
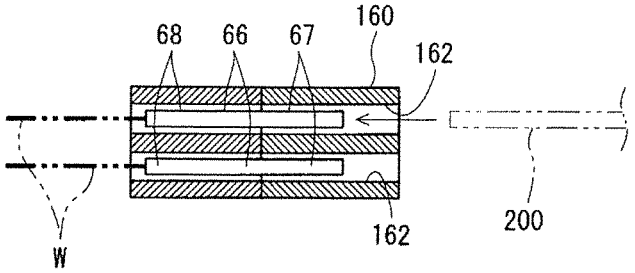
FIG. 5 is a schematic section showing the sub-connector with cap according to the first modification.

The male terminal 56, 66 is formed by appropriately press-forming a metal plate or the like and includes a wire connecting portion (see FIG. 5 for a wire connecting portion 68 of the male terminal 66) and a male terminal portion 57, 67, which are connected in a straight line (see FIG. 5).

An end part of a wire W is connected to the wire connecting portion 68, such as by crimping. Normally, the wire connecting portion 68 includes a crimping piece crimpable to a core of the end part of the wire W and the end part of the wire W and the wire connecting portion 68 are connected by caulking the crimping piece to the core.

The male terminal portion 57, 67 is an elongated part formed into a long and thin plate or a pin (here, long and thin plate) and is insertable into and connectable to the female terminal portion 17.

The male terminals 56, 66 are accommodated and held in all or some of the cavities 54, 64 of the connector housing 52, 62. The male terminals 56, 66 are held by the connector housing 52, 62 so that the male terminal portions 57, 67 thereof project out from the connector housing 52, 62. Specifically, if one principal surface of the connector housing 52, 62 serves as a facing surface 52*f*, 62*f* facing the mating connector 10, the male terminal portions 57, 67 are oriented to project from this facing surface 52*f*, 62*f*. The connector housing 52, 62 itself is not formed with a part surrounding the facing surface 52*f*, 62*f*. Thus, the male terminal portions 57, 67 can be seen to be projecting from the connector housing 52, 62 when the connector housing 52, 62 is seen as a whole.

Note that, normally, each male terminal 56, 66 is positioned and supported at a fixed position in the cavity 54, 64, such as by locking the female terminal 56, 66 by a locking piece (part also called a locking lance) that is formed to project into the cavity 54, 64.

Note that the connector housing 52, 62 is formed with a protruding portion 52*a*, 62*a* for assembling and holding with the frame 32. Here, the protruding portion 52*a*, 62*a* is a projection formed on the upper surface of the connector housing 52, 62. The protruding portion 52*a*, 62*a* preferably is formed such that a height thereof is reduced gradually toward the facing surface 52*f*, 62*f* of the connector housing 52, 62.

Each of the sub-connectors 50, 60 is provided on a tip part of a bundle of the wires W.

The frame 32 includes a uniting frame portion 34 and a surrounding frame portion 36. As described above, the frame 32 is a resin molded article formed of resin or the like integrally to the connector housing 42.

The uniting frame portion 34 is configured to hold the plurality of sub-connectors 40, 50 and 60 in a united state with the male terminal portions 47, 57 and 67 of the plurality of sub-connectors 40, 50 and 60 facing in the same direction.

Here, the uniting frame portion 34 defines a quadrilateral frame to project toward one lateral side of the connector housing 42 (direction projecting from the device casing 22). The uniting frame portion 34 is partitioned by a partitioning portion 33 and the respective spaces partitioned by the partitioning portion 33 are formed into quadrilateral tubular spaces corresponding to the connector housings 52, 62. The respective spaces are formed adjacent to and side by side with the connector housing 42. Recessed parts 33*g* into which the connector housing 52 is fittable are formed on one side surface of the partitioning portion 33 and a part of the uniting frame portion 34 facing this one side surface. The connector housing 52 can be fit into the space on the side of the one side surface of the partitioning portion 33 from behind the uniting frame portion 34 (in a direction opposite to a projecting direction of the male terminals 46). At this time, the connector housing 52 can be accommodated and held at a fixed position by fitting both side parts of the connector housing 52 into the recessed parts 33*g*. The connector housing 62 similarly can be fit into the space on the side of the other side surface of the partitioning portion 33 from behind the uniting frame portion 34 (in the direction opposite to the projecting direction of the male terminals 46). Note that the partitioning portion 33 may be omitted. In such a case, the size of a uniting frame portion may be set such that one or a plurality of connectors can be fit tightly.

Further, the uniting frame portion 34 is formed with locking holes 34*h* as recessed parts into which the protruding portions 52*a*, 62*a* of the respective connector housings 52, 62 are fittable. As described above, the respective protruding portions 52*a*, 62*a* are fit into the respective locking holes 34*h* to be locked with the respective connector housings 52, 62 fit in the uniting frame portion 34 and the respective facing surfaces 42*f*, 52*f* and 62*f* aligned on the same plane. In this way, the connector housings 42, 52 and 62 are maintained in such a united state that the respective facing surfaces 42*f*, 52*f* and 62*f* are arranged on the same plane and the respective male terminal portions 47, 57 and 67 project in the same direction from the respective facing surfaces 42*f*, 52*f* and 62*f*. In this state, the respective male terminal portions 47, 57 and 67 are supported at such positions and in such an alignment as to be insertable into and connectable to the respective female terminals 16 of the mating connector 10.

The surrounding frame portion 36 is configured to surround the respective male terminal portions 47, 57 and 67 of the sub-connectors 40, 50 and 60. More specifically, the surrounding frame portion 36 is configured to cover spaces in front of the respective facing surfaces 42*f*, 52*f* and 62*f* by one quadrilateral enclosure without partitioning between these spaces. That is, the surrounding frame portion 36 covers three outer sides of the connector housings 42, 62 on both ends out of the plurality of connector housings 42, 52 and 62 and two outer sides of the connector housing 52 located in the middle, and do not partition between the respective connector housings 42, 52 and 62. Thus, one unpartitioned common space is formed in the surrounding frame portion 36 and the male terminal portions 47, 57 and 67 project into this space.

The surrounding frame portion 36 surrounds the male terminal portions 47, 57 and 67 projecting from the facing surfaces 42*f*, 52*f* and 62*f*. In this way, the surrounding frame portion 36 functions to protect the male terminal portions 47, particularly functions to suppress the bending and the like of the male terminal portions 47 due to contact with others in a state before the connector unit 30 is connected to the mating connector 10. Further, the surrounding frame portion 36 functions to guide the mating connector 10 such that the male terminal portions 47, 57 and 67 and the female terminal portions 17 are connected when connecting the connector unit 30 and the mating connector 10. Thus, a projecting dimension of the surrounding frame portion 36 from the facing surfaces 42*f*, 52*f* and 62*f* is preferably not shorter than projecting dimensions of the male terminal portions 47, 57 and 67 from the facing surfaces 42*f*, 52*f* and 62*f*.

In a state before the connector unit 30, as described above, is mounted into a vehicle or the like, each component constituting the connector unit 30 is handled as the sub-connector with frame 38 mounted or to be mounted on the mounting board 20 or the like or the sub-connector 50, 60 mounted or to be mounted on the wires W. The sub-connectors 50, 60 are used as components incorporated into the sub-connector with frame 38 in a state mounted as wiring members in the vehicle or the like and used for connection to the mating connector 10.

According to the connector unit 30 and the sub-connector with frame 38 thus configured, the plurality of sub-connectors 40, 50 and 60 including the male terminals 46, 56 and 66 can be configured into the connector unit 30 by being combined by the uniting frame portion 34 of the frame 32. At this time, the surrounding frame portion 36 surrounds the male terminal portions 47, 57 and 67 of the plurality of sub-connectors 40, 50 and 60 without partitioning them. This surrounding frame portion 36 can function to protect the male terminal portions 47, 57 and 67 and guide the mating connector 10. Thus, the mating connector 10 neither needs to have a split structure corresponding to the plurality of sub-connectors 40, 50 and 60, nor needs to have a dedicated design for accommodating partitions between the respective sub-connectors. In this way, restrictions on the mating connector 10 can be reduced and, for example, the connector housing 12 for general-purpose female terminals 16 can be used.

Further, since the frame 32 is formed integrally to one sub-connector 40 out of the sub-connectors 40, 50 and 60, the other sub-connectors 50, 60 can be incorporated into the frame 32 integrally formed to the sub-connector 40. In this way, the number of components and the number of assembling steps can be reduced.

Further, in this embodiment, the other sub-connectors 50, 60 can be united with the sub-connector 40 fixedly mounted on the mounting board 20. Thus, electrical connection reliability through the male terminals 46 of the sub-connector 40 can be improved. For example, if an ECU for controlling the operation of an airbag is mounted on the mounting board 20, a circuit of the mounting board 20 can be electrically connected to the female terminal 16 of the mating connector 10 through one male terminal 46 and the number of connection positions between the circuit on the mounting board 20 and the mating connector 10 can be reduced. Therefore the reliability of the wiring can be improved.

{Modifications}

Figure 4:
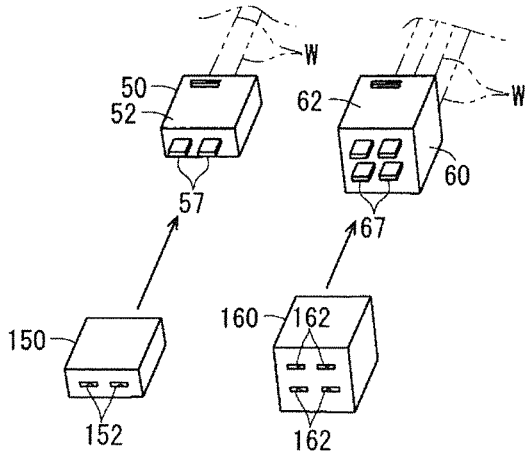
FIG. 4 is a schematic perspective view showing sub-connectors with caps according to a first modification.

FIG. 4 is a schematic perspective view showing sub-connectors with caps according to a first modification, and FIG. 5 is a schematic section showing the sub-connector with cap.

Specifically, in the above sub-connectors 50, 60, the male terminal portions 57, 67 project from the connector housings 52, 62 in a state before being assembled with the sub-connector with frame 38. Thus, while the sub-connectors 50, 60 are handled, the male terminal portions 57, 67 may contact other parts.

Accordingly, in this first modification, caps 150, 160 for covering the male terminal portions 57, 67 projecting from the connector housings 52, 62 are mounted on the sub-connectors 50, 60.

The cap 150, 160 is a rectangular parallelepiped member formed of resin or the like and formed with holes 152, 162 at positions corresponding to the respective male terminal portions 57, 67. The holes 152, 162 are sized so that the male terminal portions 57, 67 are insertable therein. Preferably, the holes 152, 162 are sized so that the male terminal portions 57, 67 can be press-fit therein, and the detachment of the caps 150, 160 is suppressed by press-fitting the male terminal portions 57, 67 into the holes 152, 162.

Further, the holes 152, 162 are shaped so that an external checking terminal 200 (may be also called a probe pin) can come into contact. Here, the holes 152, 162 penetrate through the caps 150, 160 and the terminal 200 can be brought into contact with the male terminal portions 57, 67 by being inserted through openings on tip sides of the caps 150, 160. This enables a continuity check or the like for the male terminals 56, 66 of the sub-connectors 50, 60 to be carried out with the caps 150, 160 mounted on the sub-connectors 50, 60. Further, the male terminal portions 57, 67 can be protected by the caps 150, 160 in a state before the sub-connectors 50, 60 are incorporated into the frame 32.

Further, when the sub-connectors 50, 60 are incorporated into the frame 32, the male terminal portions 57, 67 are protected by the surrounding frame portion 36 so that the caps 150, 160 are not necessary.

Figure 6:
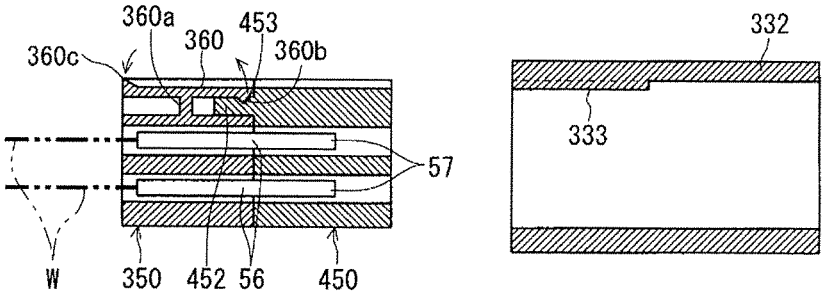
FIG. 6 is a schematic perspective view showing a sub-connector with cap according to a second modification.

Accordingly, a preferable configuration is such that a cap 450 corresponding to the cap 150 can be detached when a sub-connector 350 corresponding to the sub-connector 50 is incorporated into a frame 332 corresponding to the frame 32 as in a second modification shown in FIG. 6.

In the second modification, an extending piece 452 for locking projects on the cap 450. A locking piece 360 for locking is provided on the side of the sub-connector 350. When the sub-connector 350 is fit into the frame 332, a pressing protrusion 333 of the frame 332 presses the locking piece 360 to release locking between the extending piece 452 and the locking piece 360. As a result, a locked state of the cap 450 to the sub-connector 350 is released and the cap 450 can be detached easily.

More specifically, the extending piece 452 is provided on the cap 450 to project toward the sub-connector 350. The extending piece 452 is formed with a receiving recess 453.

The locking piece 360 is provided in a widthwise part of a top part of the sub-connector 350. The locking piece 360 is elongated along a front-back direction of the sub-connector 350 (extending direction of the male terminal portions 57) and pivotally supported via a supporting portion 360*a* in an intermediate part in an extending direction thereof. An inward facing part of a tip part of the locking piece 360 is formed with a lock protrusion 360*b* that can fit into the above-described receiving recess 453 and a pressed portion 360*c* projects on an outward facing part of a base end part of the locking piece 360.

Further, the pressing protrusion 333 capable of pressing the pressed portion 360*c* projects at a position corresponding to the pressed portion 360*c* on the inner peripheral surface of the frame 332.

When mounting the cap 450 on the sub-connector 350, the extending piece 452 is inserted below the inward facing part of the tip part of the locking piece 360 and the lock protrusion 360*b* is fit into the receiving recess 453. In this way, the cap 450 is held with detachment from the sub-connector 350 suppressed. Note that the male terminal portions 57 are inserted loosely into holes of the cap 450.

When the sub-connector 350 is fit into the frame 332, the pressing protrusion 333 presses the pressed portion 360*c* inwardly of the sub-connector 350. Then, the locking piece 360 is pivoted with a supported position by the supporting portion 360*a* as a fulcrum and the tip part of the locking piece 360 is displaced out. In this way, the lock protrusion 360*b* comes out of the receiving recess 453 and the cap 450 can be detached easily from the sub-connector 350. In this state, the cap 450 preferably is turned down to be detached.

Figure 7:
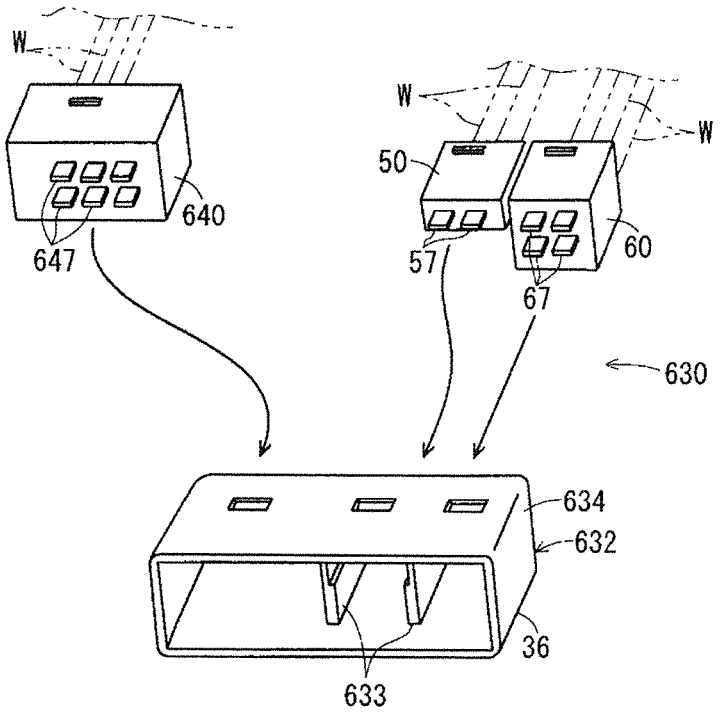
FIG. 7 is a schematic perspective view showing a connector unit according to a third modification.

FIG. 7 is an exploded schematic perspective view showing a connector unit 630 according to a third modification.

Specifically, an example has been described above in which the sub-connector 40 is formed integrally to the frame 32. However, all sub-connectors 640, 50 and 60 of the connector unit 630 may be separate from a frame 632, as in this third modification. Specifically, similar to the sub-connector 60, the sub-connector 640 is separate from the frame 632 and includes male terminal portions 647 connected to end parts of wires W. Further, the frame 632 corresponding to the frame 32 includes a uniting frame portion 634 and a surrounding frame portion 36.

The uniting frame portion 643 differs from the above uniting frame portion 34 in holding the sub-connectors 640, 50 and 60 in the united state. Specifically, the uniting frame portion 634 is formed into a quadrilateral frame and the interior is divided into a plurality of (here, three) spaces by partitioning portions 633. The sub-connectors 640, 50 and 60 are accommodated into the respective divided accommodation spaces. In this state, male terminal portions 647, 57 and 67 of the sub-connectors 640, 50 and 60 are facing in the same direction. The surrounding frame portion 36 extends farther than the uniting frame portion 634 and surrounds the respective male terminal portions 647, 57 and 67 of the sub-connectors 640, 50 and 60 without partitioning them.

The connector unit 630 according to this third modification is effective in collectively connecting the sub-connectors 640, 50 and 60 connected to the tips of a plurality of wiring harnesses to a connector of another wiring harness. For example, a harness for driving a power seat, a harness for a sensor for detecting the weight of a passenger, a harness for airbag, a harness for audio and the like may be incorporated into a seat of a vehicle. If these harnesses are connected to a floor harness of the vehicle via individual connectors, a connecting operation is cumbersome. Accordingly, if the connector unit 630 is applied, the respective sub-connectors can be connected collectively to a connector of the floor harness.

Note that the respective configurations described in the above embodiment and modifications can be appropriately combined unless these configurations are inconsistent with each other.

Although this invention has been described in detail above, the above description is illustrative in all aspects and this invention is not limited thereby. It should be appreciated that unillustrated numerous modifications can be made without departing from the scope of this invention.

LIST OF REFERENCE SIGNS

W wire
10 mating connector
42, 52, 62 connector housing
54, 64 cavity
16 female terminal
17 female terminal portion
20 mounting board
30, 630 connector unit
32, 332, 632 frame
34, 634 uniting frame portion
36 surrounding frame portion
38 sub-connector with frame
40, 50, 60, 350, 640 sub-connector
42*f*, 52*f*, 62*f* facing surface
46, 56, 66 male terminal
47, 57, 67, 647 male terminal portion
150, 160, 450 cap
152, 162 hole

The invention claimed is:

1. A connector unit to be connected to a mating connector, comprising:

a frame having an open front end, a rear end opposite the front end and an accommodating cavity extending through the frame from the front end to the rear end;

a first sub-connector housing formed integrally with an inner surface of the frame at a position rearward of a front end of the frame;

a mounting board mounted to the frame;

at least one first male terminal held by the first sub-connector housing and having a front end projecting out from the first sub-connector housing and to a position surrounded by the frame, the at least one first male terminal further having a rear end connected to a wiring pattern on the mounting board;

a second sub-connector housing formed separately from the first sub-connector housing and mounted into the accommodating cavity of the frame at a position substantially adjacent the first sub-connector housing, the second sub-connector housing having a front end rearward of the front end of the frame and a rear end opposite the front end; and at least one second male terminal held by the second-sub connector housing and having a rear end connected to a wire that extends out from the rear end of the second sub-connector housing and a front end projecting out from the front end of the second sub-connector housing to a position surrounded by the frame.

2. The connector unit of claim 1, further comprising:

at least one third sub-connector housing formed separately from the first and second sub-connector housings and separately from the frame and mounted into the accommodating cavity of the frame at a position substantially adjacent at least one of the first and second sub-connector housings, the third sub-connector housing having a front end rearward of the front end of the frame and a rear end opposite the front end; and at least one third male terminal mounted in the third sub-connector housing and having a rear end connected to a third wire that extends out from the rear end of the third sub-connector housing and a front end projecting out from the front end of the third sub-connector housing to a position surrounded by the frame.

3. The connector unit of claim 2, further comprising:

at least one partitioning portion in the accommodating cavity to define two sub-connector accommodating spaces for accommodating the second and third sub-connector housings.

* * * * *